United States Patent [19]

Hamparian

[11] 3,996,913

[45] Dec. 14, 1976

[54] ENGINE WITH INTERNAL SOUND ATTENUATION BARRIER

[75] Inventor: Nshan Hamparian, Brighton, Mich.

[73] Assignee: General Motors Corporation, Detroit, Mich.

[22] Filed: Sept. 29, 1975

[21] Appl. No.: 617,593

[52] U.S. Cl. ..... 123/198 R; 123/191 B; 123/41.83; 92/144

[51] Int. Cl.[2] ..... F01B 31/08

[58] Field of Search ..... 123/198 R, 191 R, 191 A, 123/191 B, 41.83, 41.84; 92/144

[56] References Cited

UNITED STATES PATENTS

| | | | |
|---|---|---|---|
| 1,529,812 | 3/1925 | Reinek | 92/144 |
| 1,940,677 | 12/1933 | Dymock | 92/144 |
| 2,683,638 | 7/1954 | Noble | 92/144 |
| 2,736,300 | 2/1956 | Flynn | 123/41.83 X |
| 2,881,751 | 4/1959 | Bodine | 123/191 B |
| 2,951,472 | 9/1960 | Skubic | 123/41.83 X |
| 3,173,407 | 3/1965 | Sampietro | 92/144 X |

*Primary Examiner*—Charles J. Myhre
*Assistant Examiner*—Ira S. Lazarus
*Attorney, Agent, or Firm*—Robert J. Outland

[57] ABSTRACT

An internal combustion engine of the type having so-called free standing cylinders or cylinder liners surrounded by an open topped coolant cavity is provided with internal sound attenuation barrier means, preferably mounted in the coolant cavity on the inner surfaces of the cylinder block walls or on the outer walls of the cylinders. The barrier means preferably comprises a rigid sheet engagable with the mounting wall and supporting a resilient sound absorbent material bonded or otherwise retained on one surface thereof. In a preferred embodiment the barrier material is a laminated steel having two spaced steel sheets bonded together by a rubber or rubber-like material encapsulated between the two sheets and formable into the desired shape of sound attentuating sleeve or barrier.

4 Claims, 6 Drawing Figures

ENGINE WITH INTERNAL SOUND ATTENUATION BARRIER

FIELD OF THE INVENTION

This invention relates to internal combustion engines and more particularly to engine constructions provided with internal sound attenuating barrier wall or sleeve means for limiting the escape of internal cylinder noises such as are caused by combustion, piston slap and the like.

BACKGROUND OF THE INVENTION

There has been some recognition in the prior art that sound absorbing materials may be applied in the various spaces and cavities of an internal combustion engine for reducing the transmission of internally created engine noises to the engine exterior. However, there remains the possibility of improvements in engine construction and selection of the suitable sound attenuating means capable of practical application to engines by mass production techniques.

SUMMARY OF THE INVENTION

The present invention provides combinations of engine cylinder block and cylinder constructions with suitable forms of laminated acoustical barrier materials capable of meeting the mentioned requirements.

The preferred engine constructions include cylinder blocks having so-called free standing cylinders or cylinder liners laterally enclosed by exterior cylinder block walls spaced from the cylinders to form an engine coolant jacket which is open at the top until closed by mounting of the engine cylinder head. Sound or noise attenuation barrier means are applied either along the interior of the cylinder block walls or the exterior of the cylinders.

The sound barrier means preferably comprise preformed walls or sleeves which are forced into place through the open top of the coolant cavity and may, for example, be constructed from a laminated steel sandwich material comprising two steel sheets bonded together by a layer of rubber or a rubber-like material encapsulated between the sheets and forming an acoustical barrier.

These and other features of the invention will be more fully understood from the following description of certain preferred embodiments taken together with the accompanying drawings.

DESCRIPTION OF THE PREFERRED EMBODIMENTS

Figure 1:
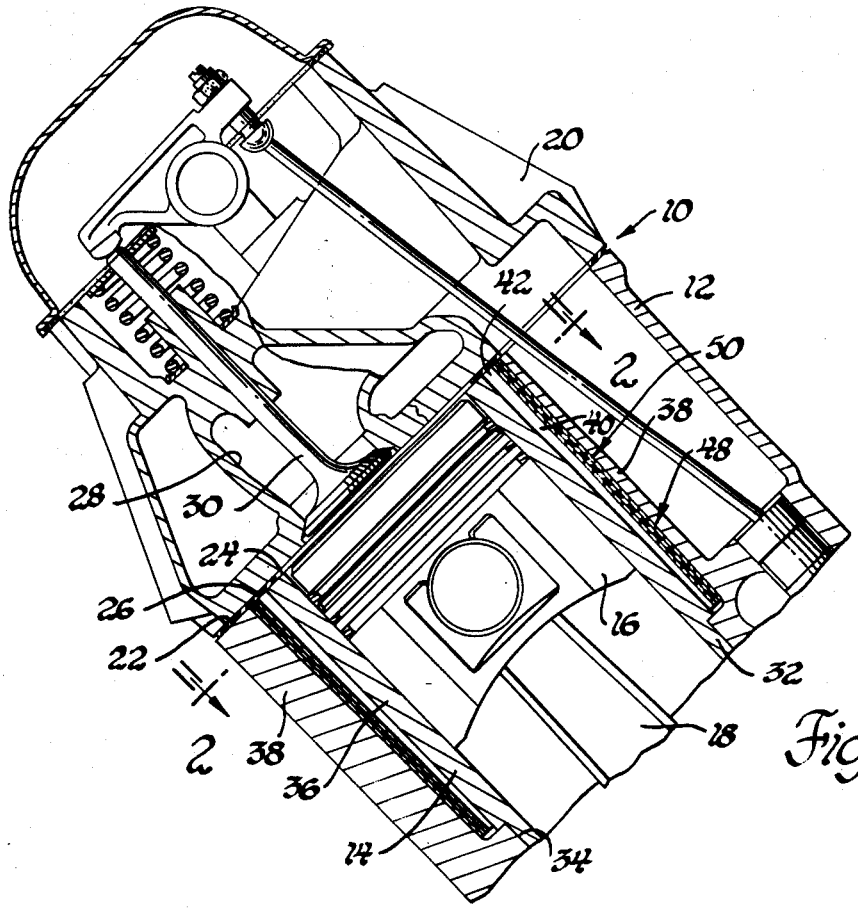
FIG. 1 is a partial transverse cross-sectional view through an internal combustion engine formed according to the invention and showing the internal construction of the cylinder block and application of noise attenuating means.

Referring now to the drawings in detail, numeral 10 generally indicates an internal combustion engine formed according to the invention. Engine 10 includes a cylinder block 12 mounting a plurality of insertable cylinder liners 14, only one being shown. Each cylinder is conventionally provided with a piston 16 reciprocable therein and connected by a connecting rod 18 to the engine crankshaft, not shown.

A cylinder head 20 is mounted on an upper end wall 22 of the cylinder block and also engages the ends 24 of the cylinder liners 14, the joints being sealed by a suitable gasket 26. The cylinder head is of conventional construction including the usual ports 28 and valves 30 for admitting and exhausting fluids from the cylinders in performance of a conventional combustion cycle.

In the performance of such a cycle, it is well known that noise is generated by the combustion process, as well as due to the motion of the pistons and the forces acting thereon which generate noise such as piston slap from the combination of reciprocating and lateral movement of the pistons within the liners.

The cylinder block is constructed so that the liners 14 are free standing; that is, they are secured in the block only at their lower ends 32 which are pressfitted into annular pilot openings 34 provided in the lower portion of the cylinder block. Above the pilot openings 34, the cylindrical walls 36 of the cylinder liners are spaced from the surrounding side walls 38 of the cylinder block, defining between them a coolant jacket 40 which is open at its upper end 42, except when closed by assembly of the cylinder head 20 on the cylinder block and liners.

In order to reduce the transmission to the engine exterior of combustion noise and mechanical noises such as piston slap created within the cylinders by operation of the engine, the invention provides for the installation of one or more sound attenuating barriers 50 within the coolant jacket between the engine cylinders 14 and the coolant jacket forming side walls 38.

In the illustrated embodiments, the sound barriers 50 are constructed of laminated sheet material 48 comprising two spaced steel sheets 52, 54 which are essentially rigid in their respective planes but are resilient and formable in other planes. The sheets 52, 54 are bonded together by and encapsulate a layer 56 of rubber or rubber-like sound absorbing material which separates the two sheets and tends to dampen and reduce the transmission of sound between them. Such laminated rubber-steel sheets 48 may be provided in flat form which can be formed essentially in the manner of steel sheets into the desired shape for use in the various forms disclosed in the drawings.

This construction is particularly suitable for such applications, since one of the sheets provides a mounting surface for engaging one of the interior walls of the coolant jacket, while the other of the sheets protects the rubber or other resilient sound absorbing material from abrasion by contact with the flowing coolant within the cylinder jacket. However, while the disclosed sandwich construction is preferred, it is within the scope of the invention to utilize other constructions of sound barrier materials which may be preformed and installed within the engine cylinder jacket in the manner disclosed herein.

Figure 2:
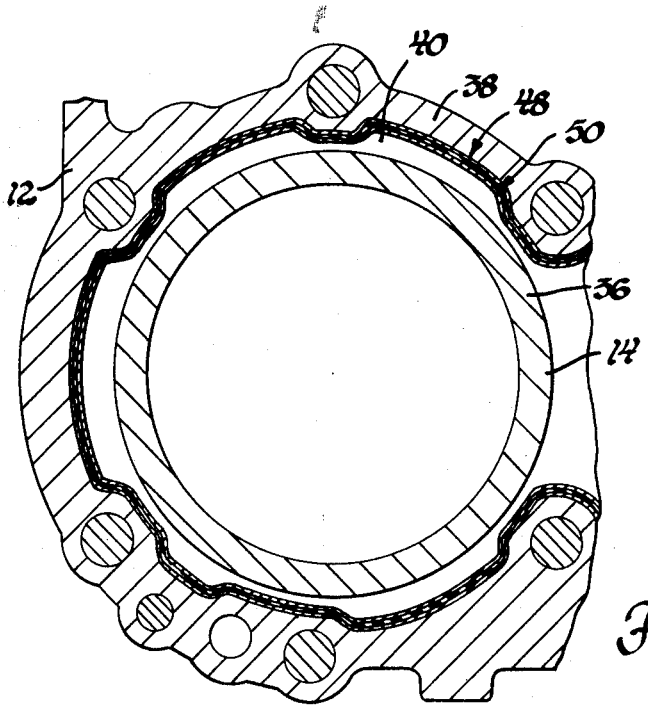
FIG. 2 is a cross-sectional view through a cylinder as viewed from the plane indicated by the line 2—2 of FIG. 1.
Figure 3:
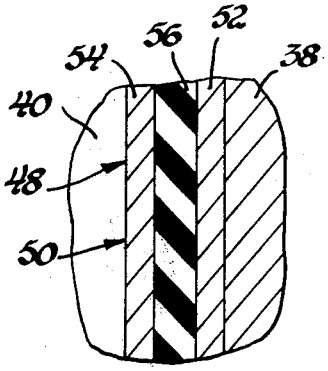
FIG. 3 is an enlarged cross-sectional view illustrating the sandwich construction of the sound attenuating barrier and its application to the cylinder block wall.

In the embodiment of FIGS. 1–3, a single sound attenuation barrier 50 is preformed to have the shape of the internal coolant jacket forming surfaces of the cylinder block side walls 38. Thereafter, the barrier 50 is installed, when the cylinder head is removed, by sliding or pressing the barrier through the open end 42 of the coolant jacket into its side wall engaging position. In its installed position, shown enlarged in FIG. 3, the outer steel sheet 52 of the barrier mounts on and engages the block walls 38, while the inner steel sheet 54 is exposed to coolant within the coolant jacket. The separating layer of rubber-like material 56, which bonds together and is encapsulated between the steel sheets 52, 54 provides a resilient sound absorbent connection between them.

Figure 4:
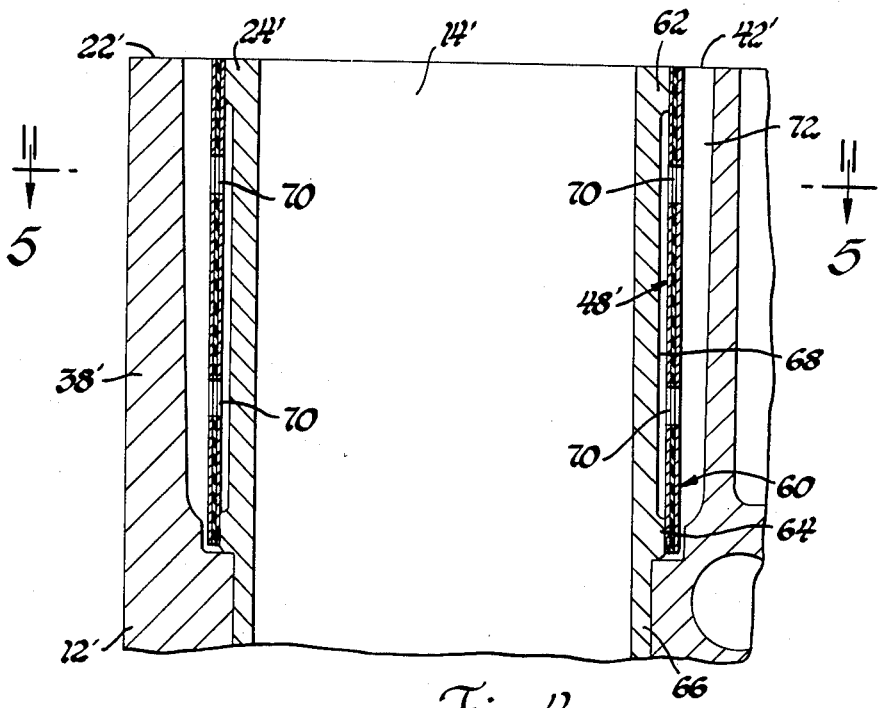
FIG. 4 is a transverse cross-sectional view showing an alternative embodiment wherein noise attenuating barriers are applied to and retained on the exteriors of the cylinder liners.
Figure 5:
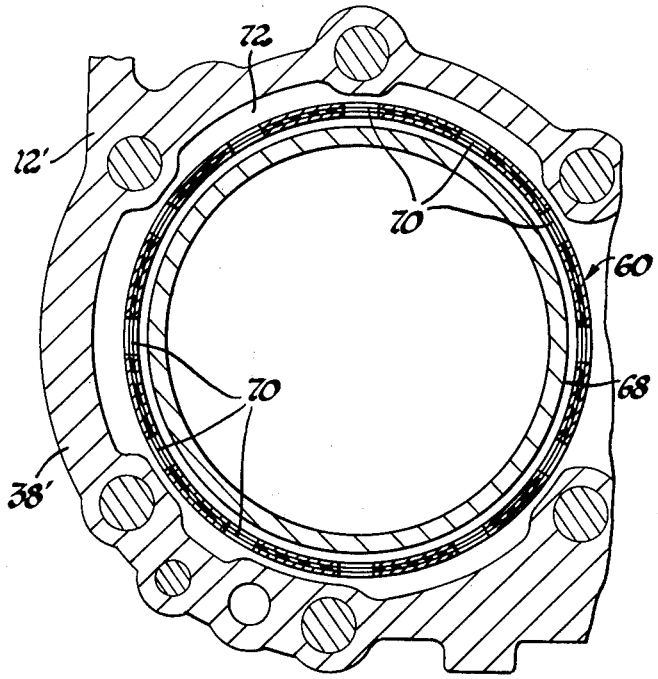
FIG. 5 is a cross-sectional view through a cylinder as viewed from the plane indicated by the line 5—5 of FIG. 4.
Figure 6:
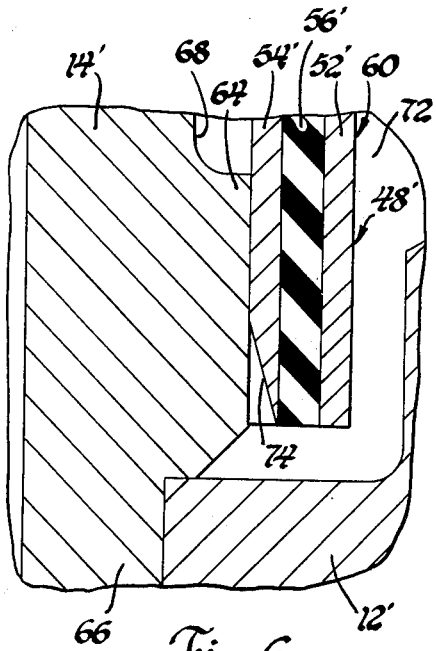
FIG. 6 is an enlarged cross-sectional view illustrating the construction of the sound attenuating barrier sleeves and their application to the cylinder liners.

The alternative embodiment shown in FIGS. 4–6 of the drawings differs from the first disclosed embodiment primarily in that a plurality of sound attenuation barriers are provided, formed as cylindrical sleeves 60 which are mounted on raised annular lands 62, 64 located on the upper and lower ends of the liner portions above their pilot sections 66. Intermediate the lands, the outer diameter of the liners walls are reduced, as at 68, creating clearance spaces between the walls and the cylindrical sleeves 60. A plurality of openings 70 extend radially through the sleeves 60 at various locations around the liner reduced diameter portions 68 to permit circulation of coolant from the surrounding coolant jacket 72 into the clearance spaces and along the walls of the cylinder liners.

The remaining portions of the engine construction are similar to the first embodiment previously described and similar components are identified with primed numerals. In addition, the cylindrical sleeves are formed of rubber-steel laminated sandwich material of the type illustrated for use as a sound attenuating barrier in the first described embodiment.

It is anticipated that the cylindrical sleeves 60 will be installed on the liner lands 62, 64 by pressing the sleeves in place and retaining them by their press fit. This step would logically be done before the liners are press fitted in their locations in the engine block. However, it would also be possible to install the cylindrical sleeves after the liners are in place. These sleeves could also be removed and replaced, if necessary, upon removal of the engine cylinder head. To aid installation of the sleeves, the lower inner edge is preferably chamfered, as at 74.

Various modifications of the proposed constructions are contemplated, and it is anticipated that additional variations may also be conceived within the skill of the art. For example, the sound barrier members, whether cylindrical sleeves or wall engaging formed members, may include a split line where the formed ends are butted together. Alternatively, the butt ends may be welded or otherwise secured together to form a solid ring-like member for close fitting in or retention on its mating component. Additionally, the construction of the sound attenuation barriers could be altered to provide only a single metal supporting sheet with a layer of sound absorbing material on the surface away from the mounting wall. In such a case the sound attenuating material would need to be abrasion resistant, as well as capable of surviving direct exposure to the engine coolant. Further, if desired, the cylinder sleeves could be cast integrally with the engine cylinder block, rather than formed as separate liners. As these changes are merely exemplary of those which may be made in the illustrated embodiments of the invention disclosed without departing from the inventive concepts, it is intended that the invention not be limited except by the language of the following claims.

What is claimed is:

1. An internal combustion engine comprising a cylinder block having side walls terminating in an end face and defining a cavity open through said end face, a cylinder formed by a wall in said block cavity and having an outer surface, a major portion of said surface being spaced from said block walls, a cylinder head mounted on said block end face and closing one end of said cylinder and the open end of said cavity, a piston reciprocably movable in said cylinder and defining with said cylinder and cylinder head a variable volume combustion chamber at said cylinder closed end, and a sound attenuation barrier in said cavity between opposing spaced portions of said cylinder block side wall and cylinder wall members to reduce the transmission of sound therebetween, said barrier being insertable through the open end of said cavity when said cylinder head is removed and engaging one of said block side wall and cylinder wall members while being spaced from the other of said members, said barrier comprising a laminated material including a supporting base sheet element having one side thereof mounted against the engaged one of said block and cylinder wall members, and a resilient sound absorbent material retained on the other side of said base sheet element.

2. An internal combustion engine comprising a cylinder block having side walls terminating in an end face and defining a cavity open through said end face and capable of receiving a plurality of cylinder defining liners, said cavity having a bottom wall opposite said end face with a plurality of liner supporting bores therethrough, a plurality of cylinder liners received in said block cavity and having walls supported at their lower ends in said bores, said liners having upper ends extending in spaced relation with one another and with said block side walls to define a coolant jacket around said liners, a cylinder head mounted on said block end face and closing the ends of said liners and the open end of said coolant jacket cavity, pistons reciprocably movable in said liners and defining, with said head and their respective liners, variable volume combustion chambers at the closed liner ends, and noise attenuation barrier means in said coolant jacket and removably mounted between said cylinder liners and the cylinder block side walls to reduce the transmission of noise therebetween, said barrier means being separately formed and insertable through the open end of said coolant cavity when said cylinder head is removed and mounted against one of the oppositely spaced walls of said cylinder block and said cylinder liners, said barrier comprising a laminated material including a supporting base sheet element, rigid in the plane of said sheet and having one side thereof mounted against the engaged one of said block and cylinder liner members, and a resilient sound absorbent material retained on the other side of said base sheet element.

3. The engine of claim 2 wherein said barrier means further comprises a formed insert engaging and substantially covering the side walls of said block cavity, said laminated material including a pair of spaced rigid sheets separated by a resilient sound absorbent substance.

4. The engine of claim 2 wherein said barrier means further comprise a plurality of tubular sleeves and said laminated material includes two rigid sheets separated by a resilient sound absorbent substance, said sleeves being mounted on raised portions of the outer surfaces of said cylinder liners and including openings to permit coolant to pass through the sleeves and contact the liner surfaces inwardly of said sleeves.

* * * * *